US010794187B2

(12) United States Patent
Park et al.

(10) Patent No.: US 10,794,187 B2
(45) Date of Patent: Oct. 6, 2020

(54) ROTARY COMPRESSOR WITH A VALVE IN THE VANE

(71) Applicant: LG Electronics Inc., Seoul (KR)

(72) Inventors: Joonhong Park, Seoul (KR); Bumdong Sa, Seoul (KR)

(73) Assignee: LG Electronics Inc., Seoul (KR)

( * ) Notice: Subject to any disclaimer, the term of this patent is extended or adjusted under 35 U.S.C. 154(b) by 307 days.

(21) Appl. No.: 15/992,314

(22) Filed: May 30, 2018

(65) Prior Publication Data

US 2018/0347565 A1 Dec. 6, 2018

(30) Foreign Application Priority Data

May 30, 2017 (KR) ..... 10-2017-0067165

(51) Int. Cl.

| | |
|---|---|
| ***F01C 21/08*** | (2006.01) |
| ***F04C 18/356*** | (2006.01) |
| ***F04C 29/12*** | (2006.01) |
| ***F04C 23/00*** | (2006.01) |

(52) U.S. Cl.

CPC ..... *F01C 21/0809* (2013.01); *F01C 21/0863* (2013.01); *F04C 18/3564* (2013.01); *F04C 23/008* (2013.01); *F04C 29/126* (2013.01)

(58) Field of Classification Search

CPC ..... F01C 21/0809; F04C 14/24

See application file for complete search history.

(56) References Cited

U.S. PATENT DOCUMENTS

| | | | | |
|---|---|---|---|---|
| 3,054,389 | A * | 9/1962 | Roggenburk | F01O 21/0809 418/41 |
| 7,845,332 | B2 * | 12/2010 | Wang | F01O 21/0809 123/241 |
| 8,529,235 | B2 * | 9/2013 | Szepesy | F01C 21/0809 418/112 |
| 8,662,051 | B2 * | 3/2014 | Tathuzaki | F01O 21/0809 123/228 |
| 8,985,976 | B2 * | 3/2015 | Takahashi | F01O 21/0827 418/22 |
| 2017/0051739 | A1 * | 2/2017 | Morishita | F01O 21/0809 |

FOREIGN PATENT DOCUMENTS

| | | | | |
|---|---|---|---|---|
| EP | 0172033 | A2 * | 2/1986 | F01C 21/0809 |
| FR | 2845435 | A1 * | 4/2004 | F01C 21/0809 |

* cited by examiner

*Primary Examiner* — Mary Davis

(74) *Attorney, Agent, or Firm* — Fish & Richardson P.C.

(57) ABSTRACT

The present invention includes a case, a driving motor, a rotating shaft, a cylinder having a compression space formed in a central portion thereof, a roller, a main bearing and a sub bearing, and a vane for partitioning the compression space into a suction chamber and a compression chamber, wherein the vane includes a vane housing provided with a space portion and a communication hole formed through one side of a front end portion thereof to form a flow path of a compressed refrigerant, and a valve member slidably installed in the space portion of the vane housing and selectively communicating the space portion with the compression chamber, wherein the flow path of the compressed refrigerant is formed by the movement of the valve member.

20 Claims, 8 Drawing Sheets

ROTARY COMPRESSOR WITH A VALVE IN THE VANE

CROSS-REFERENCE TO RELATED APPLICATION

Pursuant to 35 U.S.C. § 119(a), this application claims the benefit of an earlier filing date of and the right of priority to Korean Application No. 10-2017-0067165, filed on May 30, 2017, the contents of which are incorporated by reference herein in its entirety.

BACKGROUND

1. Field

The present invention relates to a hermetic compressor, and more particularly, a rotary compressor in which compressed refrigerant can move through a vane.

2. Description of the Related Art

A compressor is applied to a vapor compression refrigeration cycle apparatus such as a refrigerator or an air conditioner and may be classified into a rotating type and a reciprocating type according to a method of compressing a refrigerant.

The rotating type compressor is a compressor in which a volume of a compression space is varied while a rolling piston (hereinafter, referred to as a roller) rotates or orbits (revolves) in a cylinder. The reciprocating type compressor is a compressor in which the volume of the compression space is varied while the roller reciprocates in the cylinder.

An example of the rotating type compressor is a rotary compressor that compresses the refrigerant by using rotational force of a driving unit. In recent years, the main goal of technology development is to gradually miniaturize the rotary compressor and increase its efficiency. In addition, researches for obtaining a larger cooling capacity by increasing a variable range of operation speed of a miniaturized rotary compressor have been continuously carried out.

A rotary compressor is a compressor in which a roller and a vane are in contact with each other and thus a compression space of a cylinder is divided into a suction chamber and a discharge chamber with respect to the vane. In the rotary compressor, the vane which is inserted into the cylinder performs a linear motion while the roller performs an orbiting motion. Accordingly, the suction chamber and the discharge chamber form a compression chamber whose volume is variable, thereby sucking, compressing and discharging a refrigerant.

An example of the rotary compressor is a vane rotary compressor in which a vane is inserted into a roller so as to rotate together with the roller and forms a compression space while being drawn out by centrifugal force and backpressure during the rotation. Recently, a vane rotary compressor provided with a so-called hybrid cylinder which has an inner circumferential surface formed in an oval shape or a mixed shape of oval and circle so as to reduce a frictional loss and increase compression efficiency.

A rotary compressor having a hermetic form includes a driving motor for generating driving force in an inner space of a hermetic case, and a compression unit for compressing a fluid by receiving the driving force of the driving motor.

The hermetic case is provided therein with the driving motor and a compression unit to compress and discharge a sucked refrigerant. The driving motor compresses the sucked refrigerant through the compression unit while rotating a rotating shaft.

The compressed refrigerant is discharged when each discharge valve installed at a main bearing and a sub bearing is opened. The discharged refrigerant stays in a discharge space formed by a discharge muffler and then flows into the inner space of the case. The muffler may reduce noise generated in the compression unit. The muffler is provided with a discharge port communicating with the inner space of the case. The compressed refrigerant accordingly moves to an upper portion of the case and is discharged through a discharge pipe.

In the related art rotary compressor, the compressed refrigerant moves to the discharge space in response to a movement of a discharge valve which covers a discharge hole. At this time, a loss of a refrigerant due to over-compression occurs until the discharge valve is moved by a limited area of the discharge hole and the compressed refrigerant, and a high frequency sound is generated due to the discharge valve which covers the discharge hole hitting the discharge hole due to its movement.

Therefore, it is necessary to study a structure of a compressor which can improve operation efficiency of a valve, prevent over-compression of a refrigerant by increasing force to open the valve, and reduce noise generated during a discharge process.

SUMMARY

One aspect of the present invention is to provide a compressor employing a vane of a new structure, capable of allowing a flow of a compressed refrigerant through the vane and serving as a discharge valve.

Another aspect of the present invention is to enhance compressor efficiency by reducing a loss of refrigerant due to over-compression of the refrigerant caused during a discharge process of a compressed refrigerant.

Another aspect of the present invention is to provide a structure of a vane having an improved operating performance as a discharge valve for discharging a compressed refrigerant.

Another aspect of the present invention is to provide a structure of a compressor capable of reducing a mechanical frictional loss by reducing contact force generated between a vane and an outer surface of a roller.

According to an aspect of the present invention, there is provided a rotary compressor including a driving motor installed inside a case, a rotating shaft coupled to the driving motor to transmit rotational force, a cylinder provided inside the case and having a compression space formed in a circular central portion thereof, a roller coupled to the rotating shaft to orbit in the compression space, a main bearing and a sub bearing coupled to upper and lower portions of the cylinder, respectively, and a vane protruding along a vane slot formed in one side of the cylinder to be brought into contact with the roller so as to partition the compression space into a suction chamber and a compression chamber. The vane may include a vane housing provided with a space portion, and a communication hole formed through one side of a front end portion thereof so as to form a flow path of a compressed refrigerant, and a valve member installed to be slidable in the space portion of the vane housing and selectively communicating the space portion with the compression chamber. The valve member may be movable due to an increase in internal pressure of the compression chamber, which may allow the flow of the compressed refrigerant, thereby preventing an over-compression of the compressed refrigerant.

In addition, since the vane slot formed in the cylinder may be shifted in position and thus the cylinder has an asymmetric shape with respect to a virtual line passing through a center of the cylinder, a contact point which is formed between the vane housing located in the vane slot and an outer circumferential surface of the roller may be shifted, such that an area of a front end portion of the vane housing exposed to the compression chamber can be greater than an area of the front end portion of the vane housing exposed to the suction chamber. Accordingly, a mechanical frictional loss occurring between the vane and the roller can be reduced, thereby increasing durability and efficiency of the compressor.

In a rotary compressor having such structure, when pressure of a predetermined value or more is generated in a compression chamber, a compressed refrigerant can be moved due to a movement of a valve member accommodated in a vane housing. Accordingly, a vane can play a role of partitioning a compression space and a role as a discharge valve for forming a selective movement of the compressed refrigerant.

In addition, since the compressed refrigerant flowing through a communication hole of the vane housing can flow along a space portion to be discharged through a discharge hole, over-compression of the compressed refrigerant can be prevented. This may result in reducing a loss due to the over-compression of the refrigerant, thereby enhancing efficiency of the compressor.

Further, since pressure of the compressed refrigerant is applied to a front end portion of the valve member to cause the movement of the valve member and the valve member has a structure of being slidable along an inner surface of the vane housing, performance as a discharge valve can be stably realized.

Further, since a vane slot formed in the cylinder is shifted by a predetermined distance from a center line of the cylinder toward the compression chamber, a contact point between a front end portion of the vane and the roller can be shifted in position to increase an area of the front end portion of the vane exposed to the compression chamber. This may result in reducing a contact force between the vane and an outer surface of the roller, thereby reducing a mechanical frictional loss.

DETAILED DESCRIPTION

Hereinafter, a rotary compressor according to the present invention will be described in detail with reference to the accompanying drawings.

A singular representation may include a plural representation unless it represents a definitely different meaning from the context.

In describing the present disclosure, if a detailed explanation for a related known function or construction is considered to unnecessarily divert the gist of the present disclosure, such explanation has been omitted but would be understood by those skilled in the art.

The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

Figure 1:
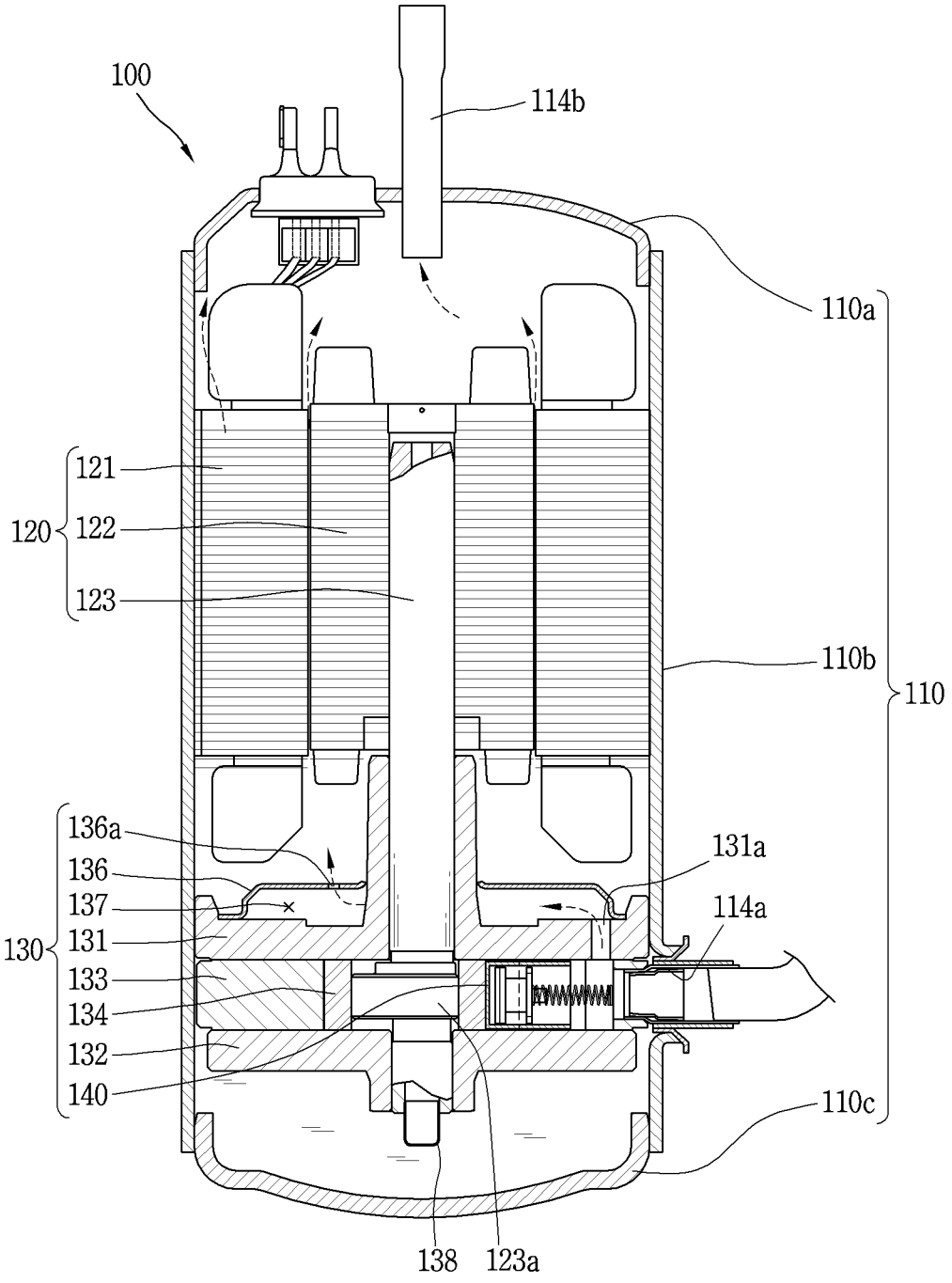
FIG. 1 is a sectional view illustrating an inner structure of a rotary compressor.

FIG. 1 is a sectional view illustrating an inner structure of a rotary compressor 100.

The rotary compressor 100 includes a case 110, a driving motor 120, and a compression unit 130.

The case 110 defines appearance of the rotary compressor. The case 110 may have a cylindrical shape extending in one direction and may be formed along an extending direction of a rotating shaft 123. The case 110 is provided therein with a cylinder 133 in which a compression space V1, V2 is formed so that a sucked refrigerant is compressed and discharged.

The case 110 is configured in a manner that an upper shell 110*a* and a lower shell 110*c* are coupled to both ends of an intermediate shell 110*b*, respectively. The upper shell 110*a* and the lower shell 110*c* are positioned at top and bottom of the intermediate shell 110*b* to restrict an exposure of internal components. The driving motor 120 and the compression unit 130 are fixedly installed on an inner surface of the intermediate shell 110*b*.

The compression unit 130 serves to compress a refrigerant, and includes a roller 134, a vane 140, a main bearing 131 coupled to an upper portion of the cylinder 133, and a sub bearing 132 coupled to a lower portion of the cylinder 133.

The driving motor 120 serves to provide driving force (power) for compressing the refrigerant and includes a stator 121, a rotor 122, and a rotating shaft 123.

The stator 121 is fixed to the inside of the case 110. The stator 121 may be mounted on an inner circumferential surface of the intermediate shell 110*b* of the cylindrical case 110 in a shrink-fitting manner or the like.

The rotor 122 may be installed inside the stator 121 with a predetermined gap from the stator 121. When power is applied to the stator 121, a magnetic field generated as current flows through the stator 121 rotates the rotor 122 by reaction with the rotor 122 so as to generate rotational force. The rotating shaft 123 inserted through a center of the rotor 122 rotates together with the rotor 122 to generate power for operating the compressor.

A suction pipe 114*a* is inserted into one side of the intermediate shell 110*b* and a discharge pipe 114*b* is inserted into one side of the upper shell 110*a* so that the refrigerant can be introduced in or discharged out of the case 110.

A suction port 133*a* formed through the cylinder 133 communicates the suction pipe 114*a* and the case 110 with an evaporator forming a refrigeration cycle in which the rotary compressor 100 is connected. Further, the discharge pipe 114*b* communicates the case 110 with a condenser of the refrigeration cycle.

The compression unit 130 installed inside the case 110 serves to compress and discharge the sucked refrigerant. The suction and discharge of the refrigerant may be made in an inner space of the cylinder 133 forming the compression space V1, V2.

A roller 134 is located inside the cylinder 133. The roller 134 rotates centering on the rotating shaft 123 inside the cylinder 133 and forms a compression space while being brought into contact with an inner circumferential surface of the cylinder 133.

The roller 134 is provided on an eccentric portion 123*a* formed on the rotating shaft 123 and thus has a rotation center different from a rotation center of the rotating shaft 123. Thus, the roller 134 compresses the refrigerant accommodated in the compression space V1, V2 while rotating in contact with the inner circumferential surface of the cylinder 133.

The vane 140 is installed in one side of the cylinder 133. The vane 140 protrudes toward the compression space V1, V2 to be located at a position to be brought into contact with an outer circumferential surface of the roller 134. The vane 140 serves to divide the compression space V1, V2 inside the cylinder 133 into a suction chamber V1 and a compression chamber V2. The vane 140 may be protruded (pressed) toward the roller 134 by pressure generated in a backpressure space 133*c* located in a rear end portion of the vane 140 or elastic force of an elastic member.

In the rotary compressor 100 according to the present invention, the refrigerant introduced into the compression space V1, V2 is compressed, flows through the vane 140, other than a discharge port which is disposed separately in the cylinder 133, and then moves into a discharge space 137 via a discharge hole 131*a* formed through the main bearing 131.

That is, in addition to the function of dividing the compression space V1, V2 into the suction chamber V1 and the compression chamber V2 by being in contact with the outer circumferential surface of the roller 134, the vane 140 also serves as a discharge valve for forming a flow path of the compressed refrigerant by interaction between a vane housing 141 and a valve member 143.

Figure 2:
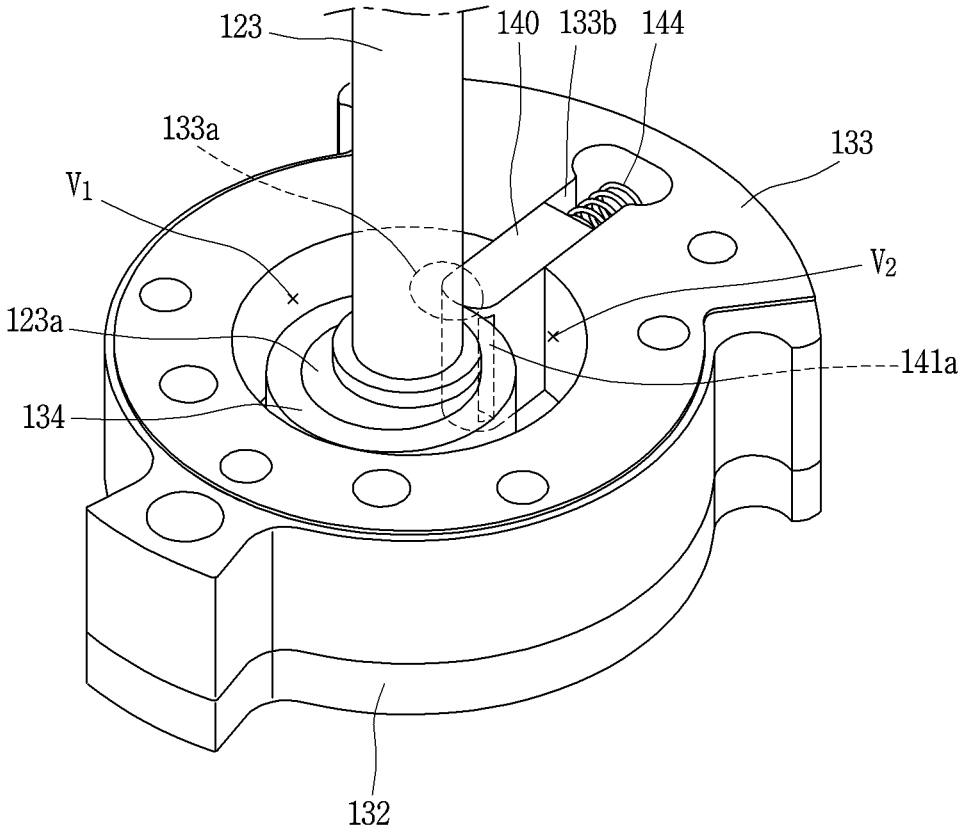
FIG. 2 is a perspective view illustrating a compression unit located inside the rotary compressor.

FIG. 2 is a perspective view illustrating the compression unit 130 located inside the rotary compressor 100.

The compression unit 130 installed in the case 110 compresses the sucked refrigerant, delivers the compressed refrigerant to an inner upper portion of the case 110 via the discharge space 137, and then transfers the refrigerant to outside through the discharge pipe 114*b*.

The compression space V1, V2 is formed in a central portion of the cylinder 133 and the compression of the sucked refrigerant is performed in a compression chamber partitioned by the vane 140.

The main bearing 131 is coupled to the upper portion of the cylinder 133 and the sub bearing 132 is coupled to the lower portion of the cylinder 133.

The cylinder 133 is provided with a roller 134 which rotates centering on the rotating shaft 123 and is brought into contact with the inner circumferential surface of the cylinder to form the compression space V1, V2.

The roller 134 is coupled with the eccentric portion 123*a* of the rotating shaft 123 so as to rotate together with the rotating shaft 123 in the compression space V1, V2. The roller 134 compresses the refrigerant while moving along the inner circumferential surface of the cylinder in the contact state. The roller 134 may move while forming virtual contact points P extending up and down along the inner circumferential surface of the cylinder. The contact points P may form a contact line extending up and down.

That is, since the roller 134 has a rotation center different from that of the rotating shaft 123, the roller 134 compresses the accommodated refrigerant while orbiting to be brought into contact with the inner circumferential surface of the cylinder.

As illustrated in FIG. 2, the vane 140 is installed in one side of the cylinder 133. The vane 140 protrudes toward the compression space V1, V2 to be brought into contact with an outer circumferential surface of the roller 134, thereby dividing the compression space inside the cylinder 133 into the suction chamber V1 and the compression chamber V2. At this time, the protrusion of the vane 140 may be made by pressure generated in a backpressure space 133*c* where the rear end of the vane 140 is located or by elastic force by an elastic member. Also, the vane 140 has a structure including a vane housing 141 in which a communication hole 141*a* is formed and a valve member 143 which performs a reciprocating motion within the vane housing 141. The valve member 143 is moved by pressure applied to the communication hole 141*a* which communicates with the compression chamber V2, so as to form a path along which the compressed refrigerant flows.

Figure 3:
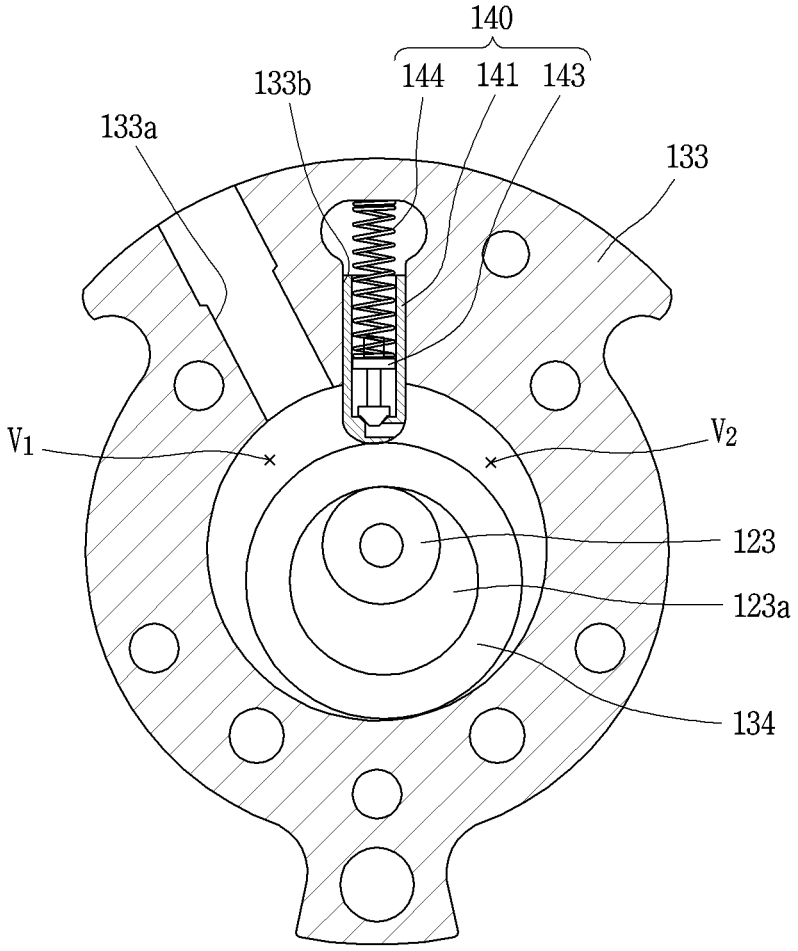
FIG. 3 is a perspective view illustrating an inside of a compression space of a rotary compressor according to the present invention.
Figure 4:
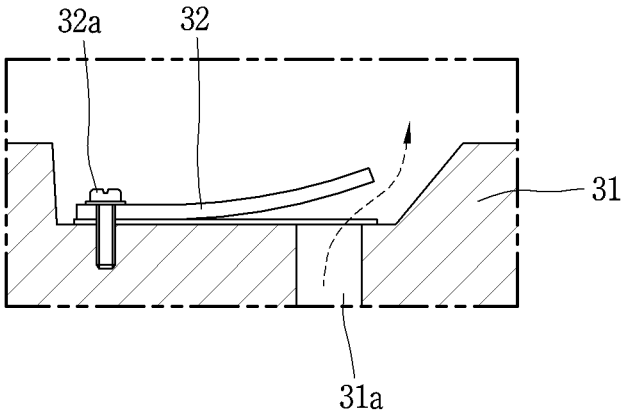
FIG. 4 is a partially enlarged view of a discharge valve provided in a discharge hole of the related art rotary compressor.

FIG. 3 illustrates a state in which the vane 140 of the rotary compressor 100 according to the present invention is located in the compression space V1, V2, and FIG. 4 illustrates a discharge valve 32 installed in a discharge hole 31*a* of the related art rotary compressor.

As illustrated in FIG. 3, the vane 140 is installed so as to be inserted into and withdrawn out of a vane slot 133*b* which is formed in one side of the cylinder 133. The valve member 143 may be located inside the vane housing 141 of the vane 140. When force applied to the valve member 143 is a predetermined value or more, the valve member 143 may be moved and accordingly a flow path of the compressed refrigerant can be formed.

As illustrated in FIG. 4, in the related art rotary compressor, the discharge hole 31*a* is opened and closed by the movement of the discharge valve 32. That is, when pressure of the compressed refrigerant increases, pressure generated in the discharge hole 31*a* increases and high pressure is applied to an opposite end of the discharge valve 32 which is fixed by a fixing pin 32*a*. Accordingly, as illustrated in FIG. 4, the discharge valve 32 is lifted so as to ensure a flow path through which the compressed refrigerant can flow.

On the other hand, the rotary compressor 100 according to the present invention can play a role of a discharge valve by the movement of the valve member 143 installed inside the vane housing 141 of the vane 140, so as to allow a faster flow of the compressed refrigerant, thereby preventing damage due to over-compression. In addition, differential pressure applied to a side surface of the vane 140 is applied through the communication hole 141*a* formed through the vane housing 141 so as to derive the movement of the valve member 143, thereby preventing a mechanical frictional loss which is caused between the vane slot 133*b* and the vane housing 141.

Figure 5:
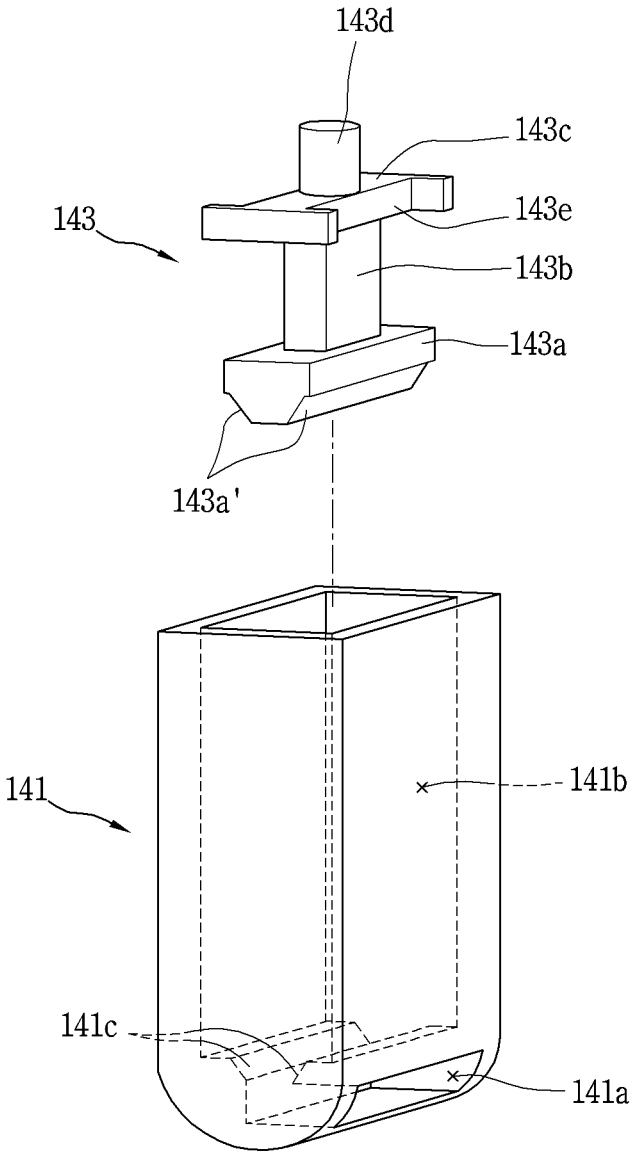
FIG. 5 is an exploded perspective view illustrating a configuration of a vane according to the present invention.

FIG. 5 is an exploded perspective view of the vane 140. As illustrated in FIG. 5, the vane 140 includes the vane housing 141 and the valve member 143.

The vane housing 141 defines an outer appearance of the vane 140 and has the space portion 141*b* therein. The communicating hole 141*a* is formed through one side of a front end portion of the vane housing 141 so as to communicate with the compression chamber.

The valve member 143 is provided in the space portion 141*b* of the vane housing 141 and is slidable in the space portion 141*b* to selectively communicate the space portion 141*b* with the compression chamber V2.

Pressure of the compression chamber V2 formed by the movement of the roller 134 may be applied to the valve member 143 through the communication hole 141*a* formed through the one side of the front end portion of the vane housing 141.

The valve member 143 includes a front portion 143*a*, a support portion 143*b*, and a rear portion 143*c*.

The valve member 143 is slid in contact with an inner surface of the vane housing 141. Specifically, horizontal and vertical lengths of the rear portion 143*c* correspond to horizontal and vertical lengths of the space portion 141*b*, respectively, so that a side surface of the rear portion 143*c* can be slit while supporting the inner surface of the vane housing 141.

The front portion 143*a* is tapered at one end into a shape of a rectangular parallelepiped so as to be interposed between the communication hole 141*a* and the space portion 141*b*. Specifically, a front support portion 141*c* is formed on an inner side of the vane housing 141 to be brought into contact with a front support portion contact surface 143*a*' formed on the front portion 143*a*.

The support portion 143*b* is coupled to the front portion 143*a* and the rear portion 143*c*, respectively. The front portion 143*a* is coupled to one end of the support portion 143*b* and the rear portion 143*c* is coupled to another end of the support portion 143*b*.

The rear portion 143*c* is coupled to one end of the support portion 143*b* and, as aforementioned, is brought into contact with the inner surface of the vane housing 141 so as to support the valve member 143 such that the valve member 143 is slidable. Both ends of the rear portion 143*c* may be slidable while supporting the inner surface of the vane housing 141.

Communication grooves 143*e* are formed by being inwardly recessed at both sides of the rear portion 143*c* to allow a flow of the compressed refrigerant introduced through the communication hole 141*a*. A spring insertion protrusion 143*d* protruding toward the cylinder 133 is formed on a rear surface of the rear portion 143*c* and thus an elastic member 144 can be inserted into the spring insertion protrusion 143*d*.

The front portion 143*a*, the support portion 143*b*, and the rear portion 143*c* may be integrally formed.

The vane housing 141 is provided with the space portion 141*d* at its center portion and the communication hole 141*a* formed through the one side of the front portion, so as to form a flow path of the compressed refrigerant.

Since differential pressure is not greatly applied to the side surface of the vane housing 141 by virtue of the communication hole 141*a* formed through the one side of the front end portion of the vane housing 141, a mechanical frictional loss occurring between the vane housing 141 and the vane slot can be reduced.

The space portion 141*d* and the communication hole 141*a* formed in the vane housing 141 may be formed in an intersecting direction and one ends thereof communicate with each other.

Figure 6:
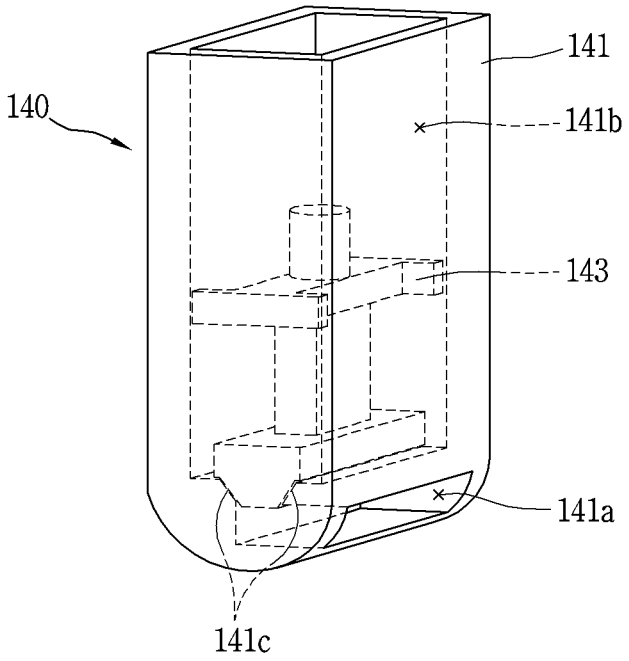
FIG. 6 is a perspective view illustrating a state in which the communication between a communication hole and a space portion is blocked by a valve member.
Figure 7:
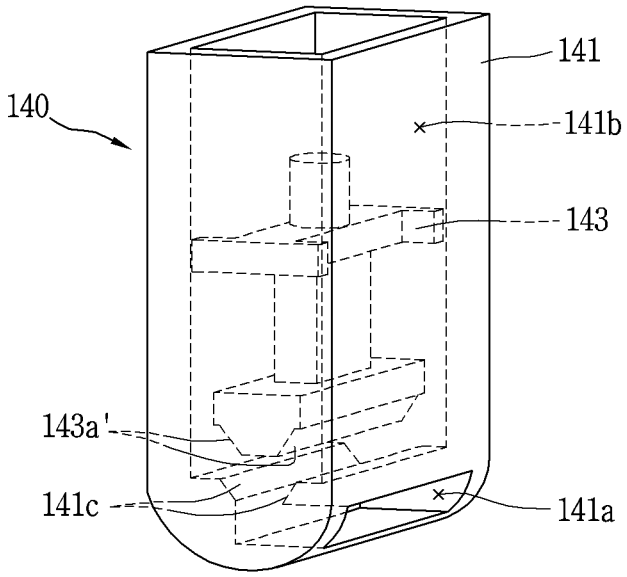
FIG. 7 is a perspective view illustrating a state in which a valve member moves upward and thus a communication hole communicates with a space portion.

FIGS. 6 and 7 are perspective views illustrating the vane 140 according to the present invention. FIG. 6 illustrates a state in which the communication between the communication hole 141*a* and the space portion 141*b* is blocked by the valve member 143, and FIG. 7 illustrates a state in which the valve member 143 moves upward to communicate the communication hole 141*a* and the space portion 141*b* with each other.

The vane 140 of the rotary compressor 100 according to the present invention not only plays a role of partitioning the compression space V1, V2 into the suction chamber V1 and the compression chamber V2 but also plays a role as the discharge valve for allowing the flow of the compressed refrigerant by virtue of the movement of the valve member 143, The refrigerant flowing into the cylinder 133 is compressed in the compression chamber V2 by the movement of the roller 134.

Since the communicating hole 141*a* formed through the front portion of the vane housing 141 communicates with the compression chamber, pressure generated in the compression chamber V2 may be applied to the front portion 143*a* of the valve member 143. As illustrated in FIG. 6, since the valve member 143 can maintain a closely-contacted state with the front support portion 141*c* of the vane housing 141 by the elastic member 144 such as a spring, the movement of the refrigerant compressed in the compression chamber V2 can be restricted. This may be seen that the discharge valve is closed.

FIG. 7 illustrates a state in which the valve member 143 moves upward and the communication hole 141*a* and the space portion 141*b* communicate with each other.

When pressure greater than a predetermined value or more is applied to the valve member 143 positioned in the vane housing 141 through the communication hole 141*a* formed through the front portion of the vane housing 141, the valve member 143 moves upward with overcoming the elastic force of the elastic member 144.

When the valve member 143 moves upward, the space portion 141*b* and the compression chamber V2 communicate with each other, such that the compressed refrigerant in the compression chamber V2 can be discharged through the discharge hole 131*a* (see FIG. 1) via the space portion 141*b*.

Figure 8:
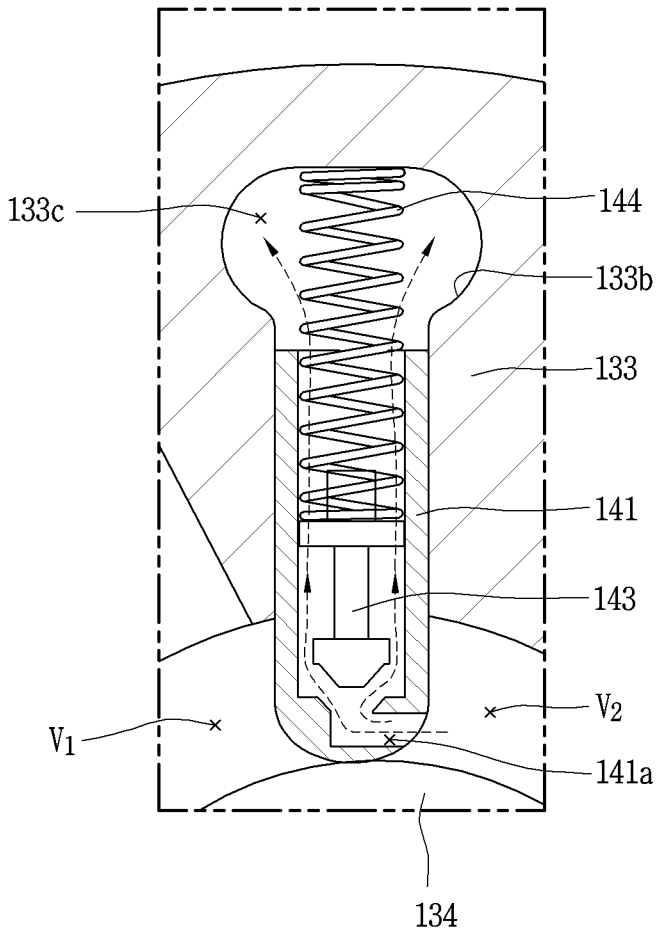
FIG. 8 is a partially enlarged view illustrating a state in which a compressed refrigerant is moved by a movement of a valve member.

FIG. 8 is a view illustrating a state in which the compressed refrigerant is moved by the movement of the valve member 143.

Since pressure of the compressed refrigerant is applied to the front portion 143*a* of the valve member 143 through the communication hole 141*a*, the valve member 143 moves upward when the pressure generated in the compression chamber V2 becomes a predetermined value or more.

In this case, as illustrated in FIG. 8, the front support portion contact surface 143*a*' of the valve member 143 and the front support portion 141*c* of the vane housing 141 are separated from each other. Therefore, the refrigerant compressed in the compression chamber V2 is introduced through the communication hole 141*a* and passes through the communication grooves 143*e* of the rear portion 143*c* of the valve member 143 so as to flow through the discharge hole 131*a* formed in an upper portion of the backpressure space 133*c*.

As described above, the movement of the compressed refrigerant can be made smoother by the movement of the valve member 143, and the loss of the refrigerant due to the over-compression occurring during the discharge process of the compressed refrigerant can be reduced, thereby enhancing efficiency of the compressor.

Also, compared to the related art discharge valve made of a thin plate-shaped metal material, the valve member has excellent reliability resulting from less anxiety about damage, and high frequency noise which is generated at a high frequency band of about 3000 to 4000 Hz due to the movement of the discharge valve can be reduced so as to be more advantageous when the compressor operates at high speed.

Figure 9:
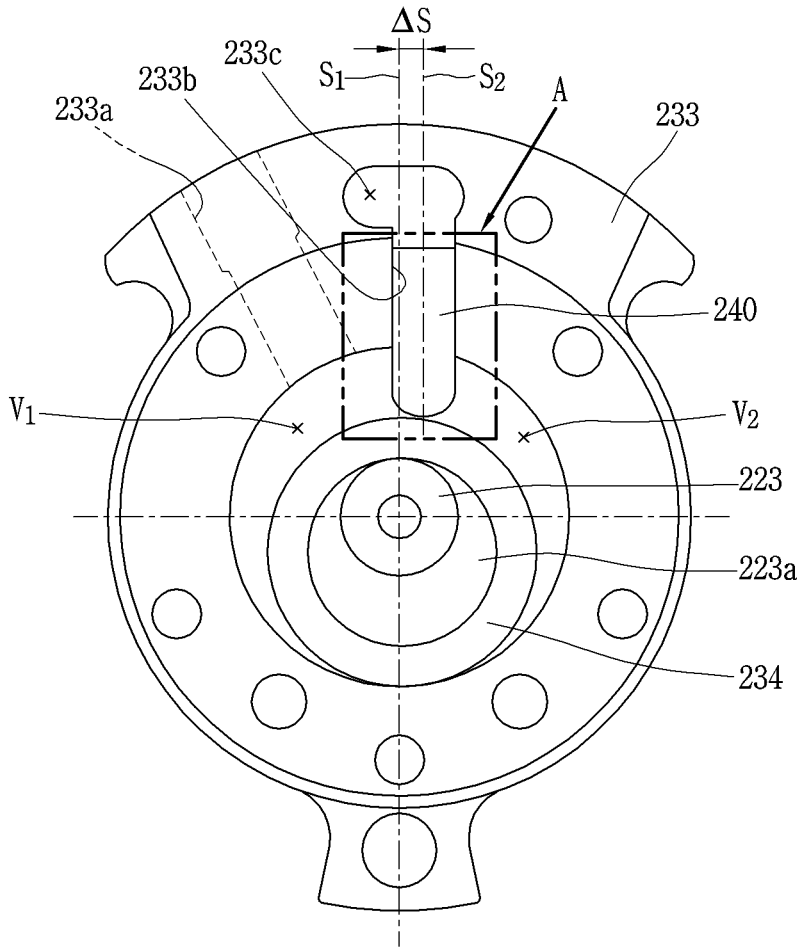
FIG. 9 is a sectional view illustrating an inner structure of a compression unit of a rotary compressor according to another embodiment of the present invention.
Figure 10:
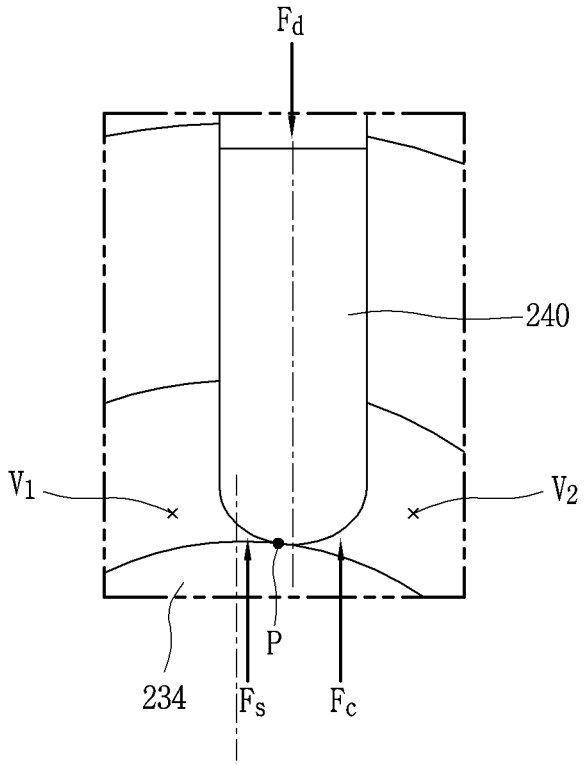
FIG. 10 is an enlarged view of an area A of FIG. 9.

FIG. 9 is a sectional view illustrating a compression unit 230 of a rotary compressor according to another embodiment of the present invention, and FIG. 10 is an enlarged view of an area A.

A compressor according to the present invention compresses a refrigerant contained in a compression chamber V2 of a cylinder 233 while a roller 234 moves along an inner circumferential surface of the cylinder 233.

Specifically, the refrigerant introduced into a suction chamber V1 through a suction port 233*a* formed in a cylinder 233 is compressed while a roller 234 rotates along an inner circumferential surface of a cylinder 233, and applies pressure to a valve member through a communication hole of a vane housing.

Although not shown in the drawing, a vane 240 includes a vane housing and a valve member, and a movement path of the compressed refrigerant is formed while the valve member moves within the vane housing.

A vane slot 233*b* is formed at one side of a central portion of the cylinder 233 to correspond to a shape of the vane 240, and a rear end side of the vane 240 is also located in a backpressure space 233*c*.

However, the vane slot 233*b* of the rotary compressor according to this embodiment may be formed at a position shifted by a predetermined distance from a virtual line passing through the center of the cylinder 233. Accordingly, as illustrated in FIG. 9, the cylinder 233 may have an asymmetrical shape having different left and right shapes with respect to the virtual line passing through the center of the cylinder 233.

Since the vane 240 is located in the vane slot 233*b*, a center line passing through a central portion of the vane 240 located in the vane slot 233*b* may be shifted by a length S from S1 to S2. In this case, as illustrated in FIG. 10, a contact point P formed between a front end of the vane 240 and an outer circumferential surface of the roller 234 may be formed at a position eccentric from the center line of the vane 240. As the contact point P moves, an area of a front end portion of the vane housing exposed to the compression chamber V2 may be greater than an area of the front-end portion of the vane housing exposed to the suction chamber V1.

The vane 240 is configured such that backpressure applied to a rear end side of the vane 240 and force applied to a front end side of the vane 240 are applied in opposite directions to each other, which causes mechanical friction between the vane 240 and the roller 234 so as to reduce efficiency of the compressor.

However, in the rotary compressor 200 according to the present invention, the area of the front end portion of the vane housing exposed to the compression chamber V2 is greater than the area of the front end portion of the vane housing exposed to the suction chamber V1, so as to increase the sum of force Fs applied by the exposed area of the front end portion of the vane 240 to the suction chamber V1 and force Fc applied by the exposed area of the front end portion of the vane 240 to the compression chamber V2. Accordingly, the mechanical friction loss occurring between the front end portion of the vane 240 and the outer circumferential surface of the roller 234 can be reduced.

The foregoing embodiments are merely illustrative to practice the rotary compressor according to the present invention. Therefore, the present invention is not limited to the above-described embodiments, and it will be understood by those of ordinary skill in the art that various changes in form and details may be made therein without departing from the scope of the present invention.

What is claimed is:

1. A rotary compressor, comprising:

a case;

a driving motor located inside of the case;

a rotating shaft coupled to the driving motor and configured to transmit rotational force from the driving motor;

a cylinder that is located inside of the case and that defines a compression space inside of the cylinder, the cylinder further defining a vane slot that is recessed from an inner circumferential surface of the cylinder and that communicates with the compression space;

a roller coupled to the rotating shaft and configured to rotate in the compression space based on the rotational force from the driving motor;

a first bearing coupled to an upper portion of the cylinder;

a second bearing coupled to a lower portion of the cylinder; and a vane that is configured to protrude from the cylinder along the vane slot toward the roller, that is configured to contact the roller, and that is configured to, based on contacting the roller, partition the compression space into a suction chamber and a compression chamber, wherein the vane comprises:

a vane housing that defines a valve space located inside of the vane housing, and a communication hole that extends from the valve space to a front end portion of the vane housing, the valve space and the communication hole defining a flow path of refrigerant, and a valve that is located in the valve space of the vane housing, that is configured to slidably move in the valve space relative to the vane housing, and that is configured to, based on movement of the valve in the valve space relative to the vane housing, selectively allow communication between the valve space and the compression chamber.

2. The rotary compressor of claim 1, wherein the valve comprises:

a front portion that is located between the communication hole and the valve space, the front portion having a tapered shape;

a support portion that has a first end connected to the front portion; and a rear portion connected to a second end of the support portion.

3. The rotary compressor of claim 2, wherein the front portion, the support portion, and the rear portion correspond to portions of one structure, respectively.

4. The rotary compressor of claim 1, wherein the valve is configured to, based on movement of the valve in the valve space relative to the vane housing, contact an inner surface of the vane housing.

5. The rotary compressor of claim 2, wherein the rear portion of the valve has end parts that are configured to support an inner surface of the vane housing based on movement of the valve in the valve space relative to the vane housing.

6. The rotary compressor of claim 2, wherein the rear portion defines a communication groove that is recessed from a side of the rear portion and that allows flow of refrigerant introduced through the communication hole.

7. The rotary compressor of claim 2, wherein the vane further comprises:

a spring insertion protrusion that extends radially outward from a rear surface of the rear portion; and an elastic member that receives the spring insertion protrusion that is configured to provide force to the valve toward the roller.

8. The rotary compressor of claim 1, wherein the valve space and the communication hole intersect with each other in the vane housing.

9. The rotary compressor of claim 1, wherein the vane slot is offset toward the compression chamber by a predetermined distance from an extension line that passes through a center of the cylinder, and wherein the cylinder has an asymmetrical shape with respect to the extension line that passes through the center of the cylinder.

10. The rotary compressor of claim 9, wherein the vane housing is configured to contact an outer circumferential surface of the roller at a contact point, wherein the front end portion of the vane housing defines, based on the vane housing contacting the outer circumferential surface of the roller, a first area that faces the suction chamber, and a second area that faces the compression chamber, and wherein the vane is configured to, based on insertion of the vane into the vane slot, shift the contact point to a position toward the compression chamber in which the second area of the front end portion is greater than the first area of the front end portion.

11. The rotary compressor of claim 6, wherein the communication groove includes:

a first communication groove recessed from a first side of the rear portion of the valve; and a second communication groove recessed from a second side of the rear portion of the valve that is opposite to the first side of the rear portion of the valve.

12. The rotary compressor of claim 7, wherein a diameter of the spring insertion protrusion is less than or equal to a width of the rear portion of the valve.

13. The rotary compressor of claim 7, wherein the elastic member contacts the rear surface of the rear portion of the valve and an inner surface of the cylinder that faces the vane slot.

14. The rotary compressor of claim 9, wherein the vane housing extends in a direction parallel to the extension line that passes through the center of the cylinder.

15. The rotary compressor of claim 10, wherein the communication hole is defined in the second area that faces the compression chamber.

16. The rotary compressor of claim 1, wherein the front end portion of the vane housing has a curved shape and is configured to contact an outer circumferential surface of the roller.

17. The rotary compressor of claim 1, wherein the communication hole is configured to communicate with the compression chamber.

18. The rotary compressor of claim 2, wherein the vane housing defines a front support portion located at an inside of the vane housing and configured to support the front portion of the valve, the front support portion of the vane housing having a shape corresponding to the tapered shape of the front portion of the valve.

19. The rotary compressor of claim 7, wherein the cylinder defines a backpressure space that is located at a rear end of the vane slot, that is configured to provide pressure to the valve toward the roller, and that receives at least a portion of the elastic member, and wherein a circumferential width of the backpressure space is greater than a circumferential width of the vane slot.

20. The rotary compressor claim 19, wherein the backpressure space extends further toward the suction chamber than toward the compression chamber.

* * * * *